US011060247B2

(12) United States Patent
Schuette

(10) Patent No.: US 11,060,247 B2
(45) Date of Patent: Jul. 13, 2021

(54) METHOD FOR CLEANING PAVING SCREEDS

(71) Applicant: Caterpillar Paving Products Inc., Brooklyn Park, MN (US)

(72) Inventor: Ryan Joseph Schuette, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 56 days.

(21) Appl. No.: 16/678,587

(22) Filed: Nov. 8, 2019

(65) Prior Publication Data

US 2021/0140129 A1 May 13, 2021

(51) Int. Cl.
*E01C 19/40* (2006.01)
*B08B 7/02* (2006.01)

(52) U.S. Cl.
CPC ..... *E01C 19/40* (2013.01); *B08B 7/02* (2013.01); *E01C 2301/00* (2013.01)

(58) Field of Classification Search
CPC ..... E01C 19/40; E01C 19/48; E01C 2301/00; B08B 7/02
USPC ..... 404/72, 114, 118
See application file for complete search history.

(56) References Cited

U.S. PATENT DOCUMENTS

| | | | | |
|---|---|---|---|---|
| 4,330,738 | A * | 5/1982 | Paramythioti | E02D 3/074 318/128 |
| 4,758,114 | A | 7/1988 | Artzberger | |
| 5,711,327 | A | 1/1998 | Fields | |
| 5,868,522 | A | 2/1999 | Campbell | |
| 6,213,681 | B1 * | 4/2001 | Sick | E01C 19/38 366/116 |
| 6,981,820 | B2 | 1/2006 | Nelson | |
| 2006/0193693 | A1 * | 8/2006 | Congdon | E02D 3/068 404/133.05 |
| 2015/0063907 | A1 * | 3/2015 | Graham | E01C 19/48 404/84.1 |

FOREIGN PATENT DOCUMENTS

| | | |
|---|---|---|
| JP | 2009138469 A | 6/2009 |
| JP | 2010090552 A | 4/2010 |

* cited by examiner

*Primary Examiner* — Raymond W Addie

(57) ABSTRACT

A method for cleaning a screed of a paving machine includes activating a vibration generator to induce a vibration into the screed such that the screed is excited at a resonant frequency of the screed to cause dislodgement of a residual build-up of a material from the screed.

20 Claims, 3 Drawing Sheets

METHOD FOR CLEANING PAVING SCREEDS

TECHNICAL FIELD

The present disclosure relates to a method and system for cleaning screeds of paving machines. More particularly, the present disclosure relates to cleaning a screed of a paving machine by inducing vibration into the screed at a resonant frequency of the screed.

BACKGROUND

Paving machines are used to deposit layers of a paving material, such as asphalt, concrete, or aggregate, on a work surface, to form roadways, parking lots, etc. A paving machine generally includes a screed that may be connected to a tractor. The screed may receive a paving material from a hopper by way of the tractor's conveying system. The conveying system generally moves the material from the hopper and deposits the material onto a region of the work surface disposed in proximity to the screed. Thereafter, the screed may be pulled over the deposited material to grade, level, and smoothen the material, over the work surface. In so doing, a layer of material is formed over the work surface with a desired degree of thickness and width.

Over the course of such operation, as the material is smoothened and layered by the screed, some portions of the material (in the form of particulates or debris) may adhere to one or more surfaces of the screed, causing an eventual residual build-up on said surfaces of the screed. As a consistent degree of material layer smoothness and quality (or the screed's operational repeatability) is desirable over several work cycles, it becomes generally pertinent to ensure that such a residual build-up is removed from the surfaces of the screed before the start of new (e.g., every new) work cycle.

Japanese Application 2009138469 ('469 reference) relates to a tamper cleaning device that facilitates removal of asphalt entering or adhering to a screed apparatus. The '469 reference discloses a nozzle for sprinkling wash liquid. The nozzle is arranged above a tamper and is connected to a pump. When a valve is opened, a wash liquid is sprinkled to the tamper and its periphery from the nozzle. Asphalt, which enters the screed apparatus from a clearance between the tamper and a screed plate, is dissolved and washed by the wash liquid and discharged outside.

SUMMARY OF THE INVENTION

In one aspect, the disclosure is directed towards a method for cleaning a screed of a paving machine. The method includes activating, by a controller, a vibration generator to induce a vibration into the screed such that the screed is excited at a resonant frequency of the screed to cause dislodgement of a residual build-up of a material from the screed.

In another aspect, the disclosure is related to a screed for a paving machine. The screed includes a vibration generator and a controller. The controller is configured to activate vibration generator to induce a vibration into the screed such that the screed is excited at a resonant frequency of the screed to cause dislodgement of a residual build-up of a material from the screed.

In yet another aspect, the disclosure is directed towards a paving machine. The paving machine includes a machine frame, a screed operably coupled to the machine frame, a vibration generator to facilitate pre-compaction of a layer of a material deposited during a material laying operation of the screed over a work surface, and a controller. The controller is configured to activate the vibration generator to induce a vibration into the screed such that the screed is excited at a resonant frequency of the screed to cause dislodgement of a residual build-up of a material from the screed.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
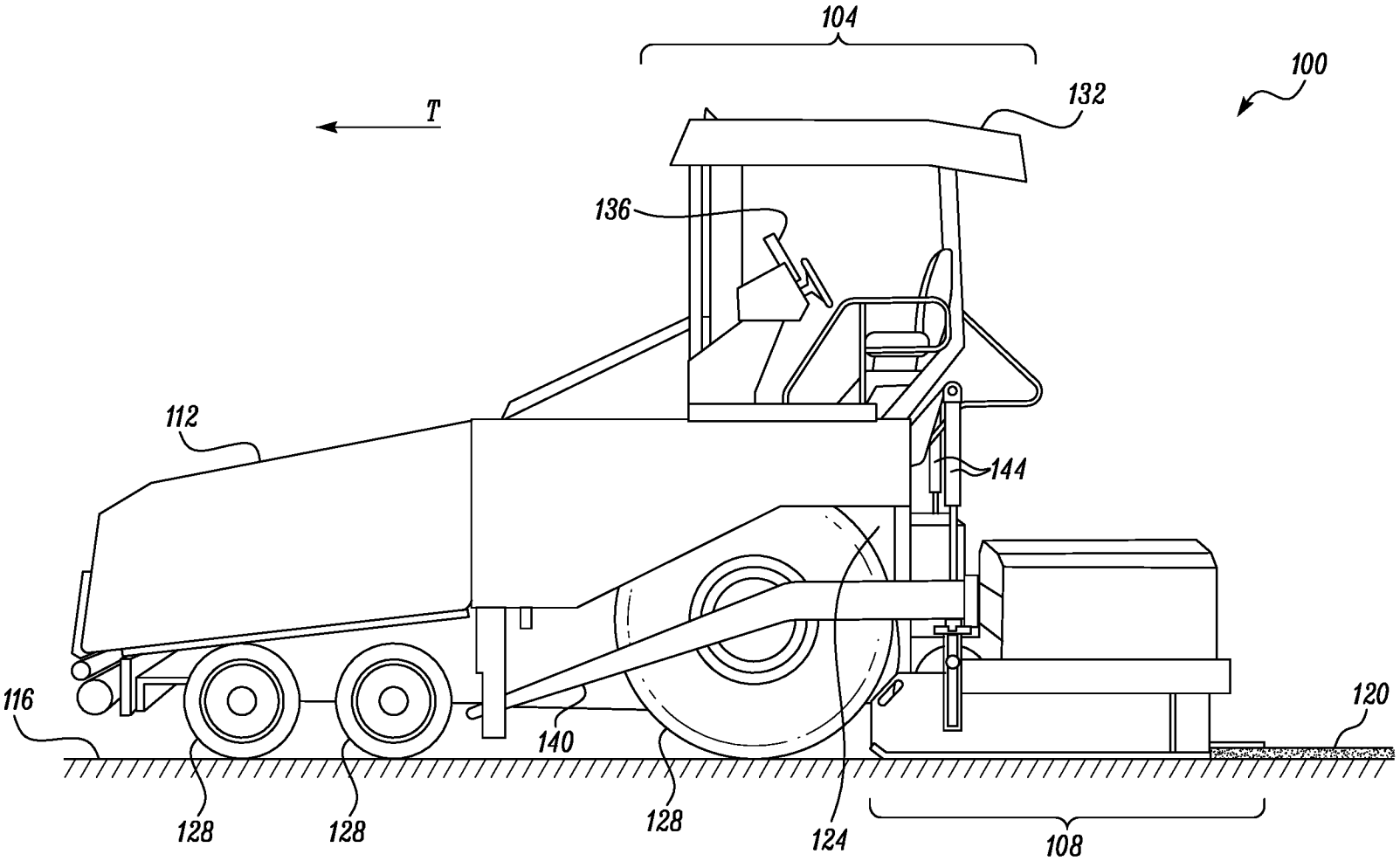
FIG. 1 is side view of a paving machine, in accordance with an embodiment of the present disclosure.

Referring to FIG. 1, a paving machine 100 is illustrated. The paving machine 100 includes a tractor portion 104 and a screed 108. The tractor portion 104 may include a hopper 112 and may tow the screed 108 along an exemplary operational direction (see direction, T). A conveying system having belts, chains, and/or augers (not shown) may be provided to transport material (e.g., a paving material, such as a hot asphalt mixture) from the hopper 112 to the screed 108. The screed 108 may receive the material and may grade, level, and shape the material, into a layer having a desired thickness and width over a work surface 116 such that a mat 120 is formed over the work surface 116. In the disclosed example, the paving machine 100 may be self-powered by way of a power source (e.g., an internal combustion engine) (not shown) supported on the tractor portion 104. It is contemplated, however, that, in some cases, the tractor portion 104 may be omitted from the paving machine 100, and the hopper 112 and/or the screed 108 may be towed by another machine (e.g., a dump truck), as and when desired.

The tractor portion 104 may include, among other components and systems, a machine frame 124, a number of traction devices 128 (e.g., tracks or wheels) to support and propel the machine frame 124 (and thus the paving machine 100) over the work surface 116, as the traction devices 128 may receive power from the power source. Further, the tractor portion 104 may include an operator station 132 supported over the machine frame 124. The operator station 132 may facilitate stationing of one of more operators therein, enabling operator control over one or more functions of the paving machine 100. For example, the operator station 132 may house one or more operator interfaces (see operator interface 136) that may be accessed by operators for controlling the many functions of the paving machine 100. In one example, the operator interface 136 may be stationed elsewhere, remote to the paving machine 100 such that the many functions of the paving machine 100 may be initiated and controlled remotely.

The machine frame 124 may also support the hopper 112, and may transmit tractive forces to the screed, e.g., by way of tow arms 140 (only one tow arm is viewable in FIG. 1) such that the screed 108 may be towed along a movement of the machine frame 124 along direction, T One or more actuators 144 may be connected between machine frame 124 and the tow arms 140, and said actuators 144 may be controlled (e.g., for example via controls provided in the operator station 132) to raise, lower, shift, and/or tilt the screed 108, relative to the machine frame 124. It is also contemplated that the screed 108 may generally be free floating, if desired, but may be suitably raised or lowered for paving operations.

Figure 2:
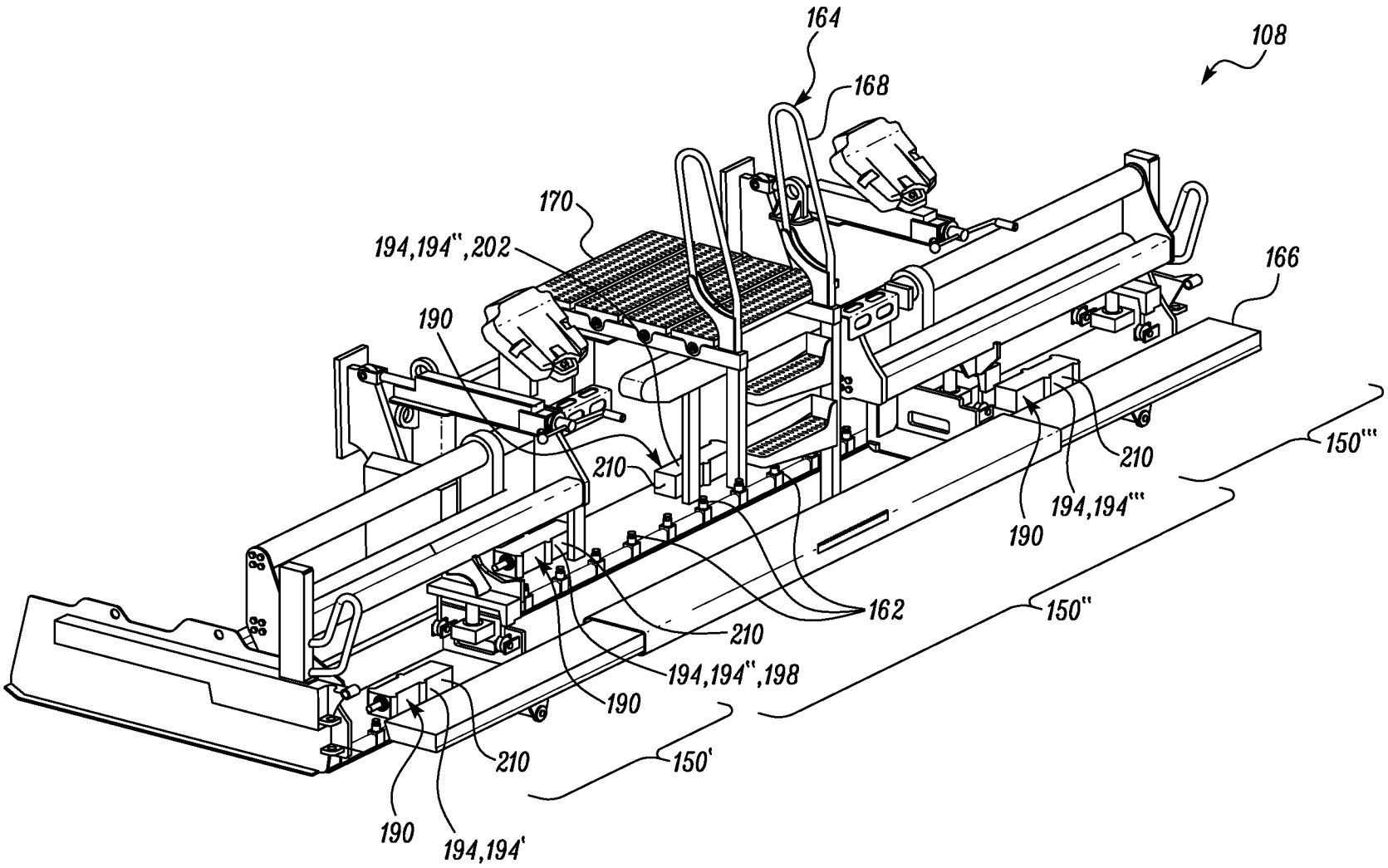
FIG. 2 is an isometric view of a screed of the paving machine, in accordance with an embodiment of the present disclosure.
Figure 3:
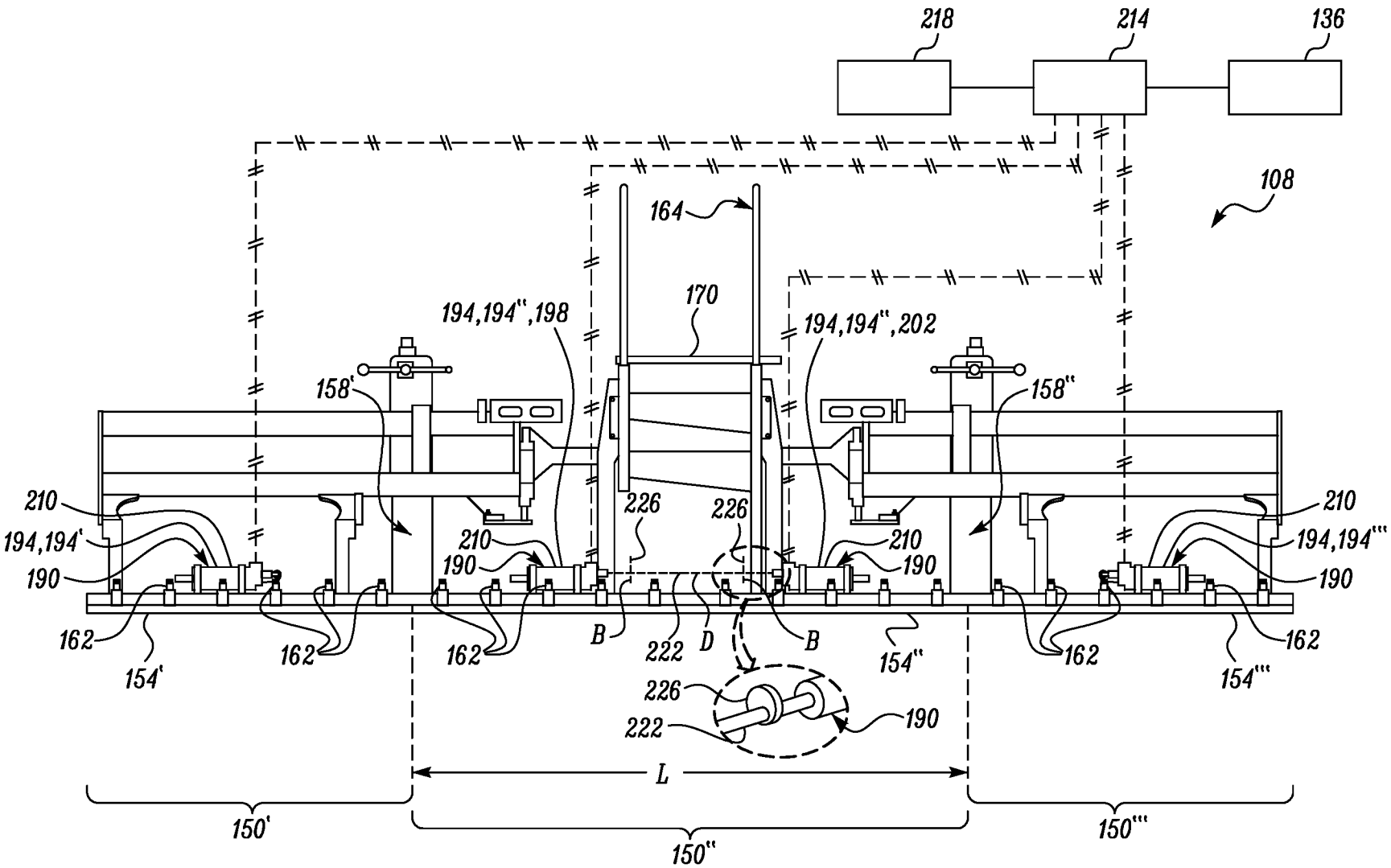
FIG. 3 is a diagrammatic view of the screed schematically illustrated in conjunction with a layout of certain components that facilitate a cleaning of the screed, in accordance with an embodiment of the present disclosure.

Referring to FIGS. 2 and 3, the screed 108 may include components (referred to as screed frames 150', 150", 150'") that may be arranged in sequence generally laterally to the tractor portion 104 or along a width of the tractor portion 104 and screed plates 154', 154", 154'" that may be respectively coupled to said screed frames 150', 150", 150'". Collectively, the screed frames 150', 150", 150'" may be referred to as screed frames 150 and the screed plates 154', 154", 154'" may be referred to as screed plates 154.

During an exemplary paving operation, if asphalt were applied as the paving material, a hot asphalt mixture may be transferred from the hopper 112, spread, and then forced under the screed plates 154 by way of the conveying system. The screed frames 150 in conjunction with the screed plates 154 may cooperate together to shape, level, and may provide pre-compaction to the inflowing asphalt mixture by way of a vibratory action of the screed 108. In that manner, a quantity of the asphalt mixture is paved by the screed plates 154, so as to form the mat 120, as the screed 108 is towed by the tractor portion 104 along the direction, T.

Although the screed frames 150 with the corresponding, screed plates 154, may be three in number, as disclosed and illustrated, the screed 108 may include a higher or a lesser number of such screed frames coupled with the corresponding screed plates. Individually, the screed frames 150', 150", 150'" may be referred to as a left screed frame 150', a main screed frame 150", and, a right screed frame 150'". The left screed frame 150' and the right screed frame 150'" may be extendably mounted at laterally opposing ends (e.g., a first lateral end 158' and a second lateral end 158") of the main screed frame 150". In so doing, the left screed frame 150' and the right screed frame 150'" may be moved in-and-out relative to the main screed frame 150" by way of one or more hydraulic rams, so as to adjust a width of the resulting layer of the mat 120. According to differing operational requirements of the screed 108, the left screed frame 150' may be moved and/or located sideways to the left of the paving machine 100 or the main screed frame 150", forward of the main screed frame 150", or rearward of the main screed frame 150". Similarly, the right screed frame 150'" may be moved and/or located sideways to the right of the paving machine 100 or the main screed frame 150", forward of the main screed frame 150", or rearward of the main screed frame 150".

Each of the screed plates 154 of the screed 108 may define a planar under face portion that may come into contact (e.g., a direct contact) with the paving material (e.g., the hot asphalt mixture) received from the hopper 112, during operations. Said planar under face portion of the screed plates 154 facilitates formation of a generally flattened top surface of the mat 120, as the paving machine 100 moves along direction, T, during operations. In some embodiments, each of the screed plates 154 may be connected to the corresponding screed frames 150 via one or more adjusting units 162 (only a few marked for clarity). The adjusting units 162 may help the screed plates 154 be adjusted with respect to the corresponding screed frames 150, in turn allowing the mat 120 to attain certain characteristics—e.g., a desired grade with respect to the work surface 116.

In some embodiments, access to the operator station 132 may be provided by way of a staircase assembly 164. The staircase assembly 164 may be mounted to the screed 108. As shown, the staircase assembly 164 may include a pedestal 166, disposed generally rearwardly to the screed 108, and a staircase 168 accessible by an operator from the pedestal 166. The staircase assembly 164 may also include a walkway platform 170 to allow operator passage into the operator station 132 from the staircase 168. For clarity, one or more of the aforesaid components of the staircase assembly 164 is removed from FIG. 3.

It may be noted that the terms 'forward/front' and 'rearward/rear', as used in the present disclosure, are in relation to an exemplary direction of travel of the paving machine 100, as represented by arrow, T, in FIG. 1. Similar connotations and understanding may be applied for the terms 'left' and 'right', as one may visualize the paving machine 100 along direction, T.

Referring to FIG. 3, the screed 108 may include a vibration generator 190. For example, the vibration generator 190 may be used to impart and/or induce vibrations into the screed 108 so as to provide the vibratory action and assist with pre-compaction of the newly laid, mat 120. In other words, the vibration generator 190 may facilitate pre-compaction of a layer of the mat 120 deposited during a material laying operation (e.g., asphalt mixture laying operation) of the screed 108 over the work surface 116. According to one aspect of the present disclosure, the vibration generator 190 may also be applied to clean the screed 108 during a 'screed clean cycle' of the screed 108. Aspects related to the such an application of the vibration generator 190 will be discussed further below.

The vibration generator 190 may include one or more vibration devices 194, for example, four vibration devices 194. Each of the vibration devices 194 may be suitably coupled to the screed 108 (i.e., to the screed frames 150 of the screed 108), as shown. The vibration devices 194 may be categorized into a left frame vibration device 194', a pair of main frame vibration devices 194", and a right frame vibration device 194'". The pair of main frame vibration devices 194'" may be individually referred to as a first vibration device 198 and a second vibration device 202, for easy reference as required.

The pair of main frame vibration devices 194" may be coupled to the main screed frame 150", as shown. Further, the left frame vibration device 194' may be coupled to the left screed frame 150' and the right frame vibration device 194'" may be coupled to the right screed frame 150'". In some embodiments, the vibration devices 194 may be rigidly connected (e.g., by bolting) to the respective screed frames 150 (e.g., to respective sub-frame portions of the screed frames 150). Further, the vibration devices 194 may be configured to generate and induce vibration into the screed frames 150, and thus into the screed 108.

In the disclosed example, the first vibration device 198 and the second vibration device 202 of the pair of main frame vibration devices 194" may be spaced apart and may be disposed axially or lengthwise along a length, L, of the main screed frame 150" (e.g., at locations that are about equidistant from the first lateral end 158' and the second lateral end 158" of the main screed frame 150"), as shown. Similarly, the left frame vibration device 194' may be disposed axially or lengthwise along a length of the left screed frame 150', generally assuming a midway position to the length of the left screed frame 150', and the right frame vibration device 194''' may be disposed axially or lengthwise along a length of the right screed frame 150''', generally assuming a midway position to the length of the right screed frame 150'''.

Each of the vibration devices 194 may include an actuator 210 that may be configured to rotate an eccentric weight. In some cases, the eccentric weight may be in direct connection with an output of the actuator 210. Alternatively, such an eccentric weight may be coupled to the actuator 210 by way of a customary mechanism, e.g., involving a shaft, etc., in order to generate and induce vibrations into the screed 108—see exemplary shaft 222 and eccentric weights 226 represented by dashed lines, D, B, respectively, in FIG. 3. In some embodiments, the actuator 210 may be a fluid actuator and/or may include a hydraulic motor. Alternatively, the actuator 210 may include an electric actuator, such as DC (Direct-Current) motors.

The screed 108 may further include a controller 214. The controller 214 may be operably coupled to each of the first vibration device 198, second vibration device 202, left frame vibration device 194', and the right frame vibration device 194''', and may also be operably coupled to the operator interface 136. For example, the controller 214 may receive a signal from the operator interface 136—such a signal may be generated when an operator of the paving machine 100 may access the operator interface 136 to feed in a request to shift the paving machine 100 from a 'paving mode' into a 'screed cleaning mode'. In response to the request or to a receipt of the signal by the controller 214, the controller 214 may retrieve a set of instructions from a memory 218 and may accordingly run the set of instructions that enables the controller 214 to shift the paving machine 100 into the 'screed cleaning mode' from the 'paving mode' and, thereafter, execute a method for cleaning the screed 108.

As part of the method, the controller 214 activates the vibration generator 190 (e.g., each of the first vibration device 198, the second vibration device 202, the left frame vibration device 194', and the right frame vibration device 194''') to induce a vibration into the screed 108 (e.g., a vibration into each of the screed frames 150 of the screed 108) such that the screed 108 is excited at a natural frequency or a resonant frequency of the screed 108 to cause dislodgement of a residual build-up of a material (e.g., the asphalt mixture) from the screed 108. As an example, the controller 214 may activate the vibration generator 190, e.g., each of the first vibration device 198, the second vibration device 202, left frame vibration device 194', and right frame vibration device 194''', simultaneously. Also, activating the vibration generator 190 may mean activating the actuators 210 associated with each of the first vibration device 198, the second vibration device 202, the left frame vibration device 194', and the right frame vibration device 194'''.

In some embodiments, the vibration generator 190 may include a variable frequency vibration generator. In such a case, the controller 214 may be configured to cause the vibration generator 190 to vibrate (e.g., in unison) within a predetermined frequency range or a predetermined frequency spectrum that may ensure the coverage of a vibration frequency capable of inducing the vibration into the screed 108 such that the screed 108 is excited at the resonant frequency of the screed 108—in so doing, residual build-up of the material is dislodged from the screed 108. In some scenarios, the predetermined frequency range is selected such that an amplitude of the vibration induced into the screed 108 is restricted within a predetermined threshold.

As an example, data associated with the functioning of the actuators 210 of each of the first vibration device 198, the second vibration device 202, left frame vibration device 194', and right frame vibration device 194''', to cause the vibration generator 190 to vibrate within the predetermined frequency range may be predetermined and stored within the memory 218. The controller 214 may fetch such data and may cause the actuators 210 to operate according to the fetched data to cause the vibration generator 190 to vibrate within the predetermined frequency range, pursuant to the receipt of the signal. For example, the controller 214 may fetch data related to a speed (e.g., angular speed) at which each of the actuators 210 need to rotate to cause the vibration generator 190 to vibrate within said predetermined frequency range. As the vibration generator 190 vibrates within the predetermined frequency range, a corresponding vibration induced into the screed 108 may be the vibration at the resonant frequency of the screed 108.

In some embodiments, the controller 214 may be configured to synchronize operations of (at least two or more) vibration devices to induce the vibration into the screed 108. For example, the rotational phase and frequency of any two or more actuators 210 may be synchronized by the controller 214, such that the resulting vibrations do not cancel out each other. In one scenario, this may be applicable for the first vibration device 198 and the second vibration device 202 that are connected to the same frame (i.e., the main screed frame 150"). That is, if the operation of these actuators 210 were not synchronized, it might be possible for vibrations induced by one vibration device (e.g., the first vibration device 198) to at least partially attenuate vibrations induced by the other vibration device (e.g., the second vibration device 202).

Additionally, or optionally, the controller 214 may synchronize motor operations of all vibration devices 194, e.g., in a simultaneous fashion, such that the operations of the left frame vibration device 194' and the right frame vibration device 194''' may be synchronized with each other and with each of the first vibration device 198 and the second vibration device 202. In so doing, a common frequency of vibration may be attained and thus induced into the entirety of the screed 108. Some examples of operational synchronization of the actuators 210 will be discussed below.

In case the actuators 210 include hydraulic motors, vibrational synchronization may be achieved in any number of different ways. For example, the controller 214 may help direct parallel flows of a pressurized fluid (e.g., rather than serial flows) to the actuators 210 of the first vibration device 198 and the second vibration device 202 of the main screed frame 150" to result in motor synchronization, as long as the pathways to each actuator 210 are substantially identical (e.g., in length). Also, a pressure and/or a speed of a fluid flow through the actuator 210, in connection with a size and eccentricity of the associated eccentric weights (e.g., eccentric weights 226), may be controlled by the controller 214 to affect an amplitude, frequency, and/or phase of the resulting vibration induced within the corresponding frame (e.g., the main screed frame 150").

As part of another example to attain vibrational synchronization between the first vibration device 198 and the second vibration device 202 in the main screed frame 150", the actuators 210 of the first vibration device 198 and the second vibration device 202 may be mechanically constrained to rotate together and achieve vibrational synchronization. For example, the actuators 210 of the first vibration device 198 and the second vibration device 202 may be coupled (e.g., by a belt drive mechanism) to a common shaft, i.e., the shaft 222 represented by dashed line, D, in FIG. 3, such that an activation of the actuators 210 of the first vibration device 198 and the second vibration device 202 may cause the shaft 222 to rotate. As may be visualized by way of dashed line, D, such a shaft 222 may be disposed along the length, L, of the main screed frame 150", i.e., between the first lateral end 158' and the second lateral end 158", and may include one or more of the eccentric weights 226, represented by dashed line, B, positioned at regular intervals on and along a length of the shaft 222. In some cases, said eccentric weights 226 may be similarly sized, as well. A rotation of the shaft 222 may cause the rotation of the eccentric weights 226.

According to the above discussion, effectively, the first vibration device 198 and the second vibration device 202 may together cause the shaft 222 to rotate in a synchronized manner. Optionally, because a single shaft (e.g., the shaft 222) is contemplated, it is possible for only a single vibration device (e.g., the first vibration device 198) to be provided with respect to the main screed frame 150" instead of the two vibration devices (i.e., the first vibration device 198 and the second vibration device 202), as disclosed. In some embodiments, similar motor and shaft arrangements, and corresponding working, may be contemplated for each of the left frame vibration device 194' and the right frame vibration device 194'", as well.

Electronic control, by the controller 214, over motor operation, e.g., closed loop control that measures and controls speed and/or phase of each motor and/or shaft, and accordingly cause the controller 214 to vary any one or more parameters of motor operation to induce vibrations into the screed 108 such that the screed 108 is excited at a resonant frequency of the screed 108, may also be possible. It is also contemplated that a combination of hydraulic, mechanical, and electrical control may be used to synchronize the vibrational input to the main screed frame 150" (and/or to the left screed frame 150' and the right screed frame 150'") so as to induce vibrations into the screed 108 such that the screed 108 is excited at a resonant frequency of the screed 108.

The controller 214 may be connected to the paving machine's electronic control module (ECM) (not shown), such as a safety module or a dynamics module, or may be configured as a stand-alone entity. Optionally, the controller 214 may be integral and be one and the same as an ECM of the paving machine 100. More particularly, the controller 214 may be a microprocessor-based device, and/or may be envisioned as an application-specific integrated circuit, or other logic devices, which provide controller functionality, and such devices being known to those with ordinary skill in the art. In one example, it is possible for the controller 214 to include or be representative of one or more controllers having separate or integrally configured processing units to process a variety of data (or input). Further, the controller 214 may be optimally suited for accommodation within certain machine panels or portions from where the controller 214 may remain accessible for ease of use, service, calibration, and repairs. Optionally, the controller 214 may also be deployed at a remote site either in proximity to the operator interface 136 or away from the operator interface 136, and, in some cases, the controller 214 may be hard-wired to the operator interface 136 and to the vibration devices 194, and to various other components and devices of the paving machine 100.

Processing units, to convert and/or process the signals from the operator interface (e.g., within the controller 214) may include, but are not limited to, an X86 processor, a Reduced Instruction Set Computing (RISC) processor, an Application Specific Integrated Circuit (ASIC) processor, a Complex Instruction Set Computing (CISC) processor, an Advanced RISC Machine (ARM) processor, or any other processor.

Examples of the memory 218 may include a hard disk drive (HDD), and a secure digital (SD) card. Further, the memory 218 may include non-volatile/volatile memory units such as a random-access memory (RAM)/a read only memory (ROM), which include associated input and output buses. The memory 218 may be configured to store the set of instruction that may be executable by the controller 214 to execute the method for cleaning the screed 108, as has been discussed above.

INDUSTRIAL APPLICABILITY

During operations, as a work cycle involving the aforementioned paving operation draws to an end, an operator of the paving machine 100 may bring the paving machine 100 to a halt, and may initiate a cleaning of the screed 108 (i.e., various components associated with the screed 108, and especially those components that may come into contact, e.g., direct contact, with the paving material or the paving mixture). This is because the paving mixture may exhibit and/or possess an intrinsic property of adhering to various materials/components it may come in contact (e.g., direct contact) with. Therefore, it is generally customary to notice adherence and residual build-up of some portions of the paving mixture (e.g., in the form of particulates or debris) onto one or more surfaces of the screed 108, e.g., onto the screed plates 154 of the screed 108. While in many of the widely practiced screed cleaning processes, it is common to involve operators and/or service personnel to manually clean a screed (e.g., the screed 108) of such build-up, one or more aspects of the present disclosure relate to mitigating or annulling the involvement of manual labor for cleaning such screeds.

According to an exemplary cleaning process, at the end of the work cycle, as the paving machine 100 may be brought to a halt, an operator of the paving machine 100 may access the operator interface 136 and may feed in a request therein to shift the paving machine 100 from a 'paving mode' into a 'screed cleaning mode' to start the screed clean cycle. As a result, a corresponding signal may be passed to the controller 214 indicating the request. In response to the signal's receipt, the controller 214 may retrieve or fetch the set of instructions from the memory 218 and may run the set of instructions. In so doing, the controller 214 may shift the paving machine 100 into the 'screed cleaning mode' from the 'paving mode' and, thereafter, executes the method for cleaning the screed. As part of the method, the controller 214 activates the vibration generator 190 to vibrate within a predetermined frequency range or a predetermined frequency spectrum to induce the vibration into the screed 108 ensuring coverage of a resonant frequency of the screed 108. In so doing, the controller 214 causes dislodgement of a residual build-up of a material (e.g., asphalt mixture) from the screed 108. As an example, the vibration induced into the screed 108 may be a natural harmonic vibration.

In some embodiments, the method may include the spraying of a release agent on to the screed 108 (e.g., to the screed plates 154, etc.) prior to activating the vibration generator 190 or prior to the start of the work cycle. The release agent may generally possess non-stick properties, mitigating the adherence of the paving mixture to the various surfaces of the screed 108 during the paving operation. Such spraying may be performed either manually or automatedly. In case such a spraying is performed automatedly, the controller 214 may have operable access to a spraying system (e.g., including reservoir, hoses, nozzles, etc.) (not shown) and may cause such a spraying system to direct the dispensation of the release agent onto relevant portions of the screed 108 (i.e., to portions of the screed 108 where paving mixture adherence is likely). Examples of the release agent may include, but may not be limited to, a diesel fuel, a soybean oil, and canola oil.

Pursuant to the shift to the 'screed cleaning mode', in some embodiments, the controller 214 activates the vibration generator 190 and keeps the vibration generator 190 activated for a predetermined period. After the predetermined period has lapsed, the controller 214 may deactivate the vibration generator 190 and may return the paving machine 100 to the previous mode (e.g., the paving mode). According to an example, during an ongoing screed clean cycle, the controller 214 may disallow operators or any personnel to (inadvertently) start any other function of the paving machine 100 (e.g., a movement of the paving machine 100) unless the predetermined period has lapsed or unless an operator feeds in a request (e.g., via the operator interface 136) to halt the screed cleaning cycle or feeds in a request to shift from the screed cleaning mode to another mode of the paving machine 100. In some embodiments, the controller 214 may facilitate the setting of regular and recurring periods (e.g., hourly, daily, weekly) during which the controller 214 may self-initiate and perform the screed clean cycle by itself.

Operating the vibration generator 190 in such a manner causes the screed 108 to be cleansed (generally to a large extent) of the residual material build-up, thereby lessening or negating the need to have operators and/or service personnel perform the arduous task of manually cleaning the screed 108, particularly when the screed 108 includes several hard-to-reach areas where a possibility for an ingress and adherence of the residual mixture remains relatively high. This reduces operator and service personnel involvement and effort with regard to screed's cleaning, along with mitigating the associated costs. Further, such cleaning of the screed 108 helps the screed 108 repeatedly achieve a generally consistent degree of pavement layer (e.g., mat 120) smoothness and quality over several work cycles.

Moreover, with such functionality an operator is at liberty to utilize any exemplary downtime period of the work cycle, e.g., when the paving machine 100 is not performing a paving operation, such as during service breaks, machine inspection periods, preventive maintenance periods, or during a period after the work cycle, to instruct the controller 214 to execute the screed clean cycle. This is because the method, as disclosed, affords an operator the flexibility to start and accomplish the screed clean cycle as and when the operator desires.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A method for cleaning a screed of a paving machine, the method comprising:

activating, by a controller, a vibration generator to induce a vibration into the screed such that the screed is excited at a resonant frequency of the screed to cause dislodgement of a residual build-up of a material from the screed.

2. The method of claim 1 further including spraying a release agent on to the screed prior to activating the vibration generator.

3. The method of claim 1, wherein the controller activates the vibration generator for a predetermined period.

4. The method of claim 1, wherein the screed includes one or more screed frames with corresponding screed plates that enable paving a quantity of the material during a paving operation, and the vibration generator includes one or more actuators correspondingly coupled to the one or more screed frames, each actuator of the one or more actuators configured to induce the vibration.

5. The method of claim 4, wherein the one or more actuators correspond to one or more hydraulic motors, and the controller is configured to synchronize a rotational phase and a frequency of the one or more hydraulic motors to induce the vibration.

6. The method of claim 1, wherein the controller is configured to activate the vibration generator such that the vibration generator vibrates within a predetermined frequency range to induce the vibration into the screed.

7. The method of claim 6, wherein the predetermined frequency range is selected such that an amplitude of the vibration is restricted within a predetermined threshold.

8. A screed for a paving machine, the screed comprising:

a vibration generator; and a controller configured to activate the vibration generator to induce a vibration into the screed such that the screed is excited at a resonant frequency of the screed to cause dislodgement of a residual build-up of a material from the screed.

9. The screed of claim 8, wherein the vibration generator facilitates pre-compaction of a layer of the material deposited during a material laying operation of the screed over a work surface.

10. The screed of claim 8 further including one or more screed frames with corresponding screed plates that enable paving a quantity of the material during a paving operation, wherein the vibration generator includes one or more actuators correspondingly coupled to the one or more screed frames, each actuator of the one or more actuators configured to induce the vibration.

11. The screed of claim 10, wherein the one or more actuators correspond to one or more hydraulic motors, and the controller is configured to synchronize a rotational phase and a frequency of the one or more hydraulic motors to induce the vibration.

12. The screed of claim 8, wherein the controller is configured to activate the vibration generator such that the vibration generator vibrates within a predetermined frequency range to induce the vibration into the screed.

13. The screed of claim 12, wherein the predetermined frequency range is selected such that an amplitude of the vibration is restricted within a predetermined threshold.

14. The screed of claim 8, wherein the controller activates the vibration generator for a predetermined period.

15. A paving machine, comprising:

a machine frame;

a screed operably coupled to the machine frame;

a vibration generator to facilitate pre-compaction of a layer of a material deposited during a material laying operation of the screed over a work surface; and a controller configured to activate the vibration generator to induce a vibration into the screed such that the screed is excited at a resonant frequency of the screed to cause dislodgement of a residual build-up of the material from the screed.

16. The paving machine of claim 15, wherein the screed includes one or more screed frames with corresponding screed plates that enable paving a quantity of the material during a paving operation, wherein the vibration generator includes one or more actuators correspondingly coupled to the one or more screed frames, each actuator of the one or more actuators configured to induce the vibration.

17. The paving machine of claim 16, wherein the one or more actuators correspond to one or more hydraulic motors, and the controller is configured to synchronize a rotational phase and a frequency of the one or more hydraulic motors to induce the vibration.

18. The paving machine of claim 15, wherein the controller is configured to activate the vibration generator such that the vibration generator vibrates within a predetermined frequency range to induce the vibration into the screed.

19. The paving machine of claim 18, wherein the predetermined frequency range is selected such that an amplitude of the vibration is restricted within a predetermined threshold.

20. The paving machine of claim 15, wherein the controller activates the vibration generator for a predetermined period.

* * * * *